United States Patent [19]

Bortfeld et al.

[11] 4,243,912

[45] Jan. 6, 1981

[54] SIMPLIFIED RESISTIVE LENS ELECTRON GUN WITH COMPOUND LINEAR VOLTAGE PROFILE

[75] Inventors: David P. Bortfeld, Kendall Park; Leon J. Vieland, Princeton, both of N.J.

[73] Assignee: RCA Corporation, New York, N.Y.

[21] Appl. No.: 70,538

[22] Filed: Aug. 28, 1979

[51] Int. Cl.[3] ..... H01J 29/96; H01J 29/62

[52] U.S. Cl. ..... 315/3; 313/414; 315/16

[58] Field of Search ..... 315/3, 16, 52, 59; 313/409, 414, 449

[56] References Cited

U.S. PATENT DOCUMENTS

| | | | |
|---|---|---|---|
| 3,932,786 | 1/1976 | Campbell | 315/3 |
| 3,995,194 | 11/1976 | Blacker et al. | 315/16 |
| 4,010,312 | 3/1977 | Pinch et al. | 428/450 |
| 4,091,144 | 5/1978 | Drenser et al. | 252/518 X |
| 4,124,810 | 11/1978 | Bortfeld et al. | 313/414 X |

*Primary Examiner*—Eugene R. LaRoche

*Attorney, Agent, or Firm*—E. M. Whitacre; G. H. Bruestle

[57] ABSTRACT

The electron gun includes a pair of electrodes between which a resistive lens structure comprising a stack of alternate apertured plates and resistive blocks is disposed. The stack comprises a first section which has two resistive blocks between each adjacent pair of electrode plates and a second section which has one resistive block between each adjacent pair of electrode plates. The lens is thereby adapted to operate with a potential profile which comprises a compound linear slope in a 1:2 ratio.

5 Claims, 11 Drawing Figures

SIMPLIFIED RESISTIVE LENS ELECTRON GUN WITH COMPOUND LINEAR VOLTAGE PROFILE

BACKGROUND OF THE INVENTION

This invention relates to electron guns for television picture tubes and particularly to electron guns which include extended focus lenses of the resistive type.

As used herein, the term resistive lens means an electrostatic focus lens in which the potential profile of the lens is established by a resistive voltage divider along the length of the lens. One type of such lens disclosed in U.S. Pat. No. 3,932,786, issued to F. J. Campbell on Jan. 13, 1976, comprises a series of apertured metal plates which are connected to spaced taps along the voltage divider. The apertured plates are supported in fixed relationship by embedding their edges along a glass support rod which also serves as a substrate for the voltage divider resistor deposited thereon.

A modification of the Campbell-type of resistive lens is disclosed in U.S. Pat. No. 4,091,144, issued to J. Dresner et al on May 23, 1978, and in a copending application, Ser. No. 51,400, filed June 25, 1979 by B. Abeles. In this modification, the apertured plates are alternately stacked with a plurality of insulator blocks, e.g. ceramic, which are coated on at least one face with a resistive material. The plates and blocks are so arranged that a high resistance continuity is established along the stack of blocks and plates from one end to the other. When a potential difference is applied across the stack, current flow is created which results in each electrode plate of the stack having a different voltage applied to it.

U.S. Pat. No. 4,124,810, issued Nov. 7, 1978 to D. P. Bortfeld et al, teaches the desirability of the potential profile of a focus lens being exponential-like along the beam path. This can be achieved in the Abelestype resistive lens simply by grading the resistance values of successive blocks along the lens stack. However, such a procedure is costly and complex in that each resistive block must be pretested and selected as to its specific resistance, and then these blocks must be carefully handled so that the blocks are correctly assembled in their proper order in the resistive stack.

For purposes of simplicity herein, no distinction is made herein between axial potential profile of a lens, i.e., the potential profile along the electron beam axis through the lens, and surface potential profile of a lens, i.e., the potential profile along the surfaces of the electrode elements of the lens in the axial direction. In practice they differ slightly, the axial profile usually being a smoothed art replica of the surface profile.

We have discovered that the optimum exponential-like voltage profile of a lens can be closely approximated by two linear slopes (i.e., linear voltage gradients) without greatly increasing lens aberrations. Furthermore, we have discovered that the values of these two linear slopes can be established, preferably with a 1:2 ratio, either in a preferred tripotential type of lens system or, in its simpliest form, in a conventional bipotential type lens or modifications thereof, such that a resistive lens according to the Abeles teaching can be constructed using only one value of resistive block, thereby greatly simplifying and cost-reducing the construction of such lenses.

As used here, the term "tripotential" describes a lens system comprising at least three electrodes, the first of which along the beam path is operated at an intermediate potential, the second at a minimum potential, and the third at the ultor or screen potential of the electron tube incorporating the lens. Electron guns having axial potential profiles of this general class are disclosed in U.S. Pat. No. 3,995,194, issued to A. P. Blacker, Jr. et al on Nov. 30, 1976.

The terms "resistive lens stack" and "resistive lens structure" are used interchangeably herein, and mean either:

(a) a portion of a total lens stack comprising a series of electrode plates and one aligned row of resistive blocks, or (b) the entire lens stack comprising a series of electrode plates and all resistive blocks thereof including those situations where a portion of the stack has two or more resistive blocks in each stage thereof.

SUMMARY OF THE INVENTION

An electron gun comprises a novel resistive lens of the stacked electrode-resistive-block type. The lens comprises a first (entrance) section which includes two resistive blocks between each adjacent pair of electrode plates and a second (exit) section which is in series with the first section, and which includes only one resistive block between each adjacent pair of electrode plates. Inclusion of two resistive blocks in each stage of the first section results in their being electrically in parallel so that the bulk resistance of each stage in the first section is one-half that of each second section stage. The main lens is thereby adapted to operate with a potential profile which comprises a compound linear slope in a 1:2 ratio.

DETAILED DESCRIPTION OF THE PREFERRED EMBODIMENT

The present invention is shown as embodied in a 3-beam in-line electron gun similar to that described in U.S. Pat. No. 3,772,554, issued to R. H. Hughes on Nov. 12, 1973. The Hughes patent is incorporated by reference herein for the purpose of disclosure. The invention may, however, be used in other types of electron guns.

Figure 1:
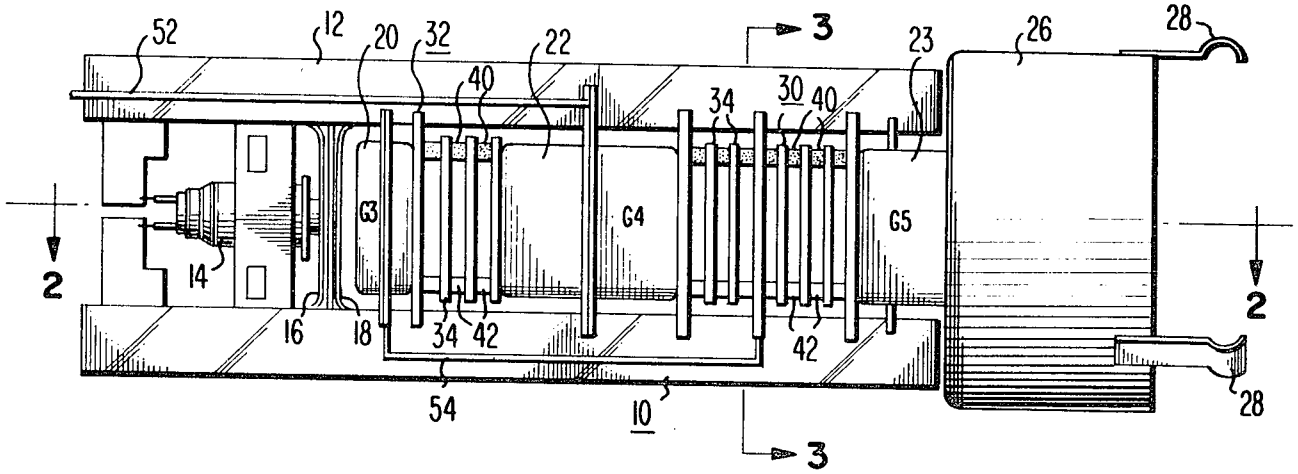
FIG. 1 is an elevation view of an electron gun with parts broken away and shown in section, which gun is electrically similar to that of the present invention.
Figure 2:
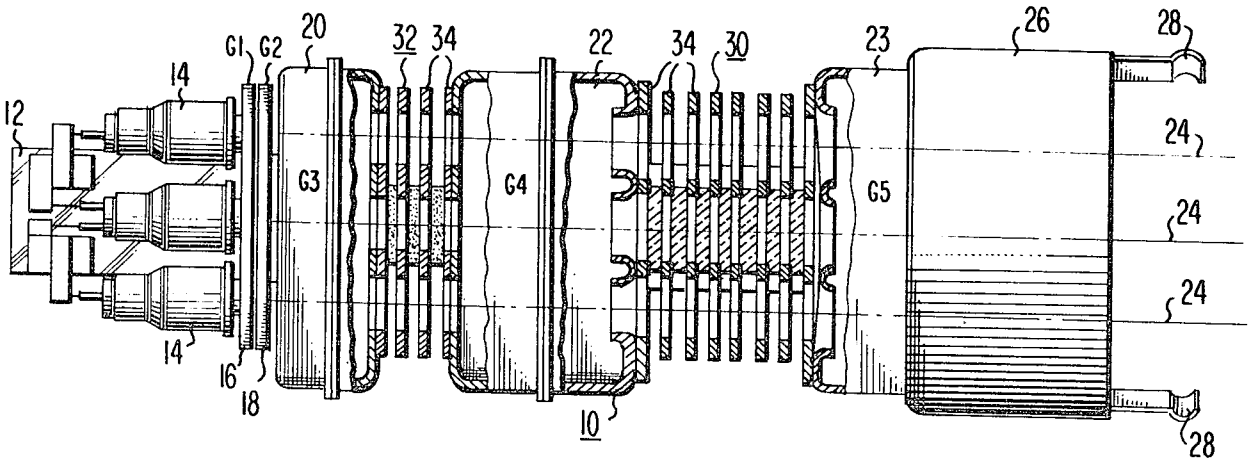
FIG. 2 is a longitudinal section view of the electron gun of FIG. 1 taken along line 2—2 of FIG. 1.

As shown in FIGS. 1 and 2, an electron gun 10 comprises two parallel glass support rods 12 on which various electron gun elements are mounted. At one end of the support rods 12 are mounted three cup-shaped cathodes 14 having emissive surfaces on their end walls. Mounted in spaced relation beyond the cathodes 14 are a control grid electrode (G1) 16, a screen grid electrode (G2) 18, a first lens electrode (G3) 20, a second lens electrode (G4) 22, and a third lens electrode (G5) 23. The three cathodes 14 project electron beams along three coplanar beam paths 24 through appropriate apertures in the electrodes.

The G1 and G2 comprise substantially flat metal members each containing three in-line apertures which are aligned respectively with the three beam paths 24.

The G3 and G4 each comprises two somewhat rectangularly shaped cups joined at their open ends. The two closed ends of the cups each have three in-line apertures which are respectively aligned with the three beam paths 24.

The G5 comprises a somewhat rectangular cup having a base which faces toward the G4 and has three in-line apertures therein respectively aligned with the three beam paths 24.

A shield cup 26 is attached to the G5 so that its base covers the open end of the G5. The shield cup 26 has three in-line apertures through its base, each aligned with one of the beam paths 24. The shield cup also has a plurality of bulb spacers 28 attached to and extending from its open end. The bulb spacers support the gun 10 within the neck of a cathode ray tube (not shown) and make electrical contact to a high-voltage-bearing coating on the neck to supply an operating voltage to the G5.

In operation, the electron gun 10 is designed to have a main focus lens established between the G4 and G5, and a secondary focus lens between the G3 and G4. To this end a stacked resistive main lens structure 30 and a stacked resistive secondary lens structure 32 are provided.

Figure 3:
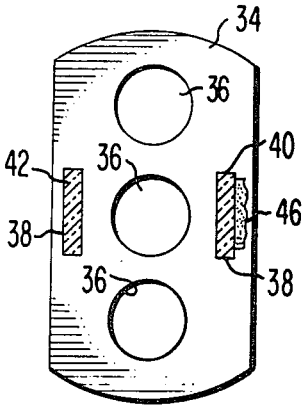
FIG. 3 is a section view taken along line 3—3 of FIG. 1 and illustrates an electrode plate and resistive block of the electron lens system of the electron gun of FIG. 1.

The stacked resistive lenses 30 and 32 are of the type described in the Abeles application, which is incorporated herein by reference for the purpose of disclosure. Each of the lenses 30 and 32 includes a plurality of electrode plates 34. As shown in FIG. 3, each plate 34 is provided with three in-line apertures 36, each of which is aligned with one of the beam paths 24. The plates 34 are alternately stacked with rectangular parallelepiped spacer blocks 38. A pair of the spacer blocks 38 are disposed between any two adjacent plates 34. Each pair of spacer blocks 38 are disposed on opposite sides of the central one of the apertures 36 and adjacent to an outer edge of a plate 34. At least one block of each pair of spacer blocks 38 comprises a resistive block 40 as hereinafter described. The other block of the pair of spacer blocks 38 may comprise either a resistive block 40 or an insulator block 42. When only one resistive block 40 is desired between a pair of electrode plates 34, an insulator spacer block 42 is also included for mechanical support purposes.

The resistive blocks 40 preferably comprise insulator blocks 42 having at least one of their surfaces coated with a layer of a suitable high resistive material. A preferred material is a cermet as disclosed in U.S. Pat. No. 4,010,312, issued to H. L. Pinch et al on Mar. 1, 1977 and incorporated herein by reference.

Figure 4:
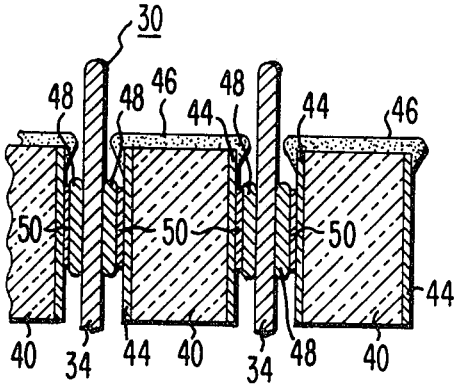
FIG. 4 is an enlarged section of the lens structure of the electron gun of FIG. 1.

As illustrated in FIG. 4, each of the resistive blocks 40 is provided with two electrically separate metallized films 44 on the two opposite surfaces thereof which contact a pair of electrode plates 34. After the resistive blocks have been provided with their metallized films 44, and prior to assemblying the blocks into the stacked lens 30 or 32, they are coated with a layer 46 of suitable high resistance material on the surface which connects the two mutually opposite film-coated surfaces. The resistive layer 46 wraps around two of the corners of the block 40 to make good overlapping contact with portions of the surfaces of the metallized films 44. The resistive blocks 40 are then assembled with the electrode plates 34 and secured thereto preferably with a suitable brazed joint 48. In order to promote wetting of the metallized film 44 with the brazing material, a portion of the film 44 is first covered with a strike 50 of nickel. The nickel strike 50 is confined to the central portion of the metallized film 44 and thus confines the flow of the brazing material.

With the resistive lens stack 30 or 32 thus secured into a unitary assembly, electrical continuity is provided from one end to the other of each stack, with each resistive block 40 providing a significant resistance between any two adjacent electrode plates 34. Thus a voltage divider resistor is provided such that when appropriate voltages are applied to the two lens electrodes at the ends of the stack, bleeder currents flow through the high resistance coatings 46 causing a voltage drop along the lens stack so as to establish a different potential on each of the electrode plates 34 thereof. Such different voltages provide a voltage gradient which produces the desired axial potential profiles of the lenses.

Using the technology described above, the resistive lens 30 is fabricated with eight electrode plates 34 and seven resistive blocks 40. As viewed in FIG. 1, the resistive blocks 40 are aligned along the top edge of the lens 30. The seven blocks aligned along the lower edge of the lens 30 are uncoated insulator blocks 42. The resistive blocks 40 are shown with stippled surfaces to distinguish them from the uncoated insulator blocks 42.

Similarly, the stacked lens structure 32 is fabricated with four electrode plates 34 and three resistive blocks 40. As shown in FIG. 1, the three resistive blocks 40 are aligned along the top edge of the lens and three insulator blocks 42 are aligned along the bottom edge of the lens.

A first electrical connector 52 is attached to the G4 and extends to the exterior of the electron tube into which the electron gun 10 is incorporated. This connector allows for application of a suitable focus voltage to the G4 lens electrode. A second connector 54 is attached at its one end to the G3 and at its other end to an intermediate electrode plate 34 of the stacked main focus lens 30. In operation of the electron gun 10, an ultor potential is applied to the G5 via the spring contacts 28 on the shield cup 26. Typically, for the electron gun 10, a focus voltage of 5.7 kV and an ultor voltage of 30 kV may be applied to the G4 and G5, respectively. The main lens structure 30 may be tapped by the connector 54 at a selected plate 34 to feed an appropriate voltage, e.g. 13 kV, to the G3.

With this arrangement, the lens stack 32 is electrically paralleled with a first or entrance section of the lens 30 (i.e., section at which the electron beam enters the lens 30) between the G4 and the intermediate electrode plate 34 to which the connector 54 is attached. If the number of resistive blocks 40 in the lens structure 32 is equal to the number of resistive blocks in the entrance section of the lens structure 30, as shown in FIG. 1, the current flow through the entrance section of the lens 30 is one-half that through the second or exit (i.e., section at which the beam exists) section between the intermediate tapped electrode plate 34 and the G5. As a result, a compound linear voltage profile is established along the lens stack 30 so that the slope of the voltage profile over the entrance section is one-half the slope of the voltage profile over the exit section. By selecting the appropriate plate to which the tap is applied, the compound linear profile can be made to very closely approximate the ideal desired exponential-like profile.

Figure 5:
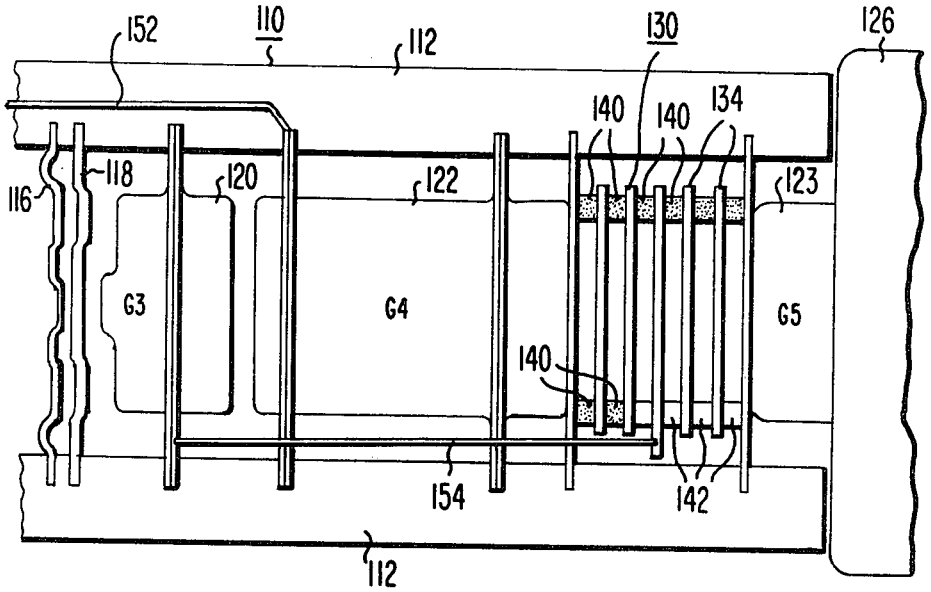
FIG. 5 is an elevation view with parts broken away of a preferred embodiment of the novel electron gun according to the present invention.

FIG. 5 illustrates a novel electron gun 110 according to the present invention which is a modification of the electron gun 10 and includes a number of similar corresponding parts to those of the gun 10. In FIG. 5 these similar corresponding parts are identified with numerals which are 100 larger than the numerals identifying the same parts in the electron gun 10 of FIGS. 1 and 2.

In the electron gun 110, the resistive lens between the G3 and G4 electrodes is omitted and only a resistive lens 130 between electrodes G4 and G5 is employed. The main focus lens 130 comprises a stack of alternate electrode plates 134 and resistive blocks 140. As shown in FIG. 5, a row of six aligned resistive blocks 140 is provided at the upper edge of the lens 130. At the lower edge of the lens, a second row of aligned blocks is provided wherein the first two blocks adjacent the G4 electrode are resistive blocks 140 and the four blocks adjacent the G5 electrode are insulator blocks 142. Electrical connections are made to the electron gun 110 by a focus voltage connector 152 connected to the G4 electrode and an interconnecting connector 154 between the G3 electrode and an intermediate electrode plate 134 of the lens structure 130. The lens 130 is thus constituted of an entrance section of two stages and an exit section of four stages.

As a result of this electrical arrangement, bleeder current flows through the connector 152 and through the resistive lens stack 130 from the G4 to the G5. Since two resistive blocks 140 are provided in each of the first and second stages of the lens stack 130, there will be half as much voltage drop in each of those stages as in each of the following four stages, each of which contains only a single resistive block 140. As a result, the potential profile established along the resistive lens stack 130 will have one value of slope along its first two stages, which is one-half the slope value along its last four stages. Thus, as with the main lens 30 of the electron gun 10, the main lens 130 of the electron gun 110 has a first entrance section which is paralleled with another resistive lens stack and a second or exit section which is in series with the entrance section. In this respect, the lower two resistive blocks 140 of the first two stages of the lens 130 may be likened to the lens stack 32 between the G3 and G4 of the electron gun 10 of FIGS. 1 and 2.

The electron gun 110 provides an inexpensive lens construction by virtue of the omission of a resistive structure between electrodes G3 and G4, while at the same time achieving the desired paralleling whereby the desired one or two slope ratio is obtained for the voltage profile along the main focus lens 130.

In designing the resistive lens stacks of electron guns 10 and 110, certain design criteria should be followed:

1. A sufficient number of total stages, i.e., resistive blocks 40 or 140, should be included in the lens stack so as to keep the electrical stress on each block, i.e., the voltage drop across each block, below an arbitray design maximum. In today's state of the art for resistive materials and processing thereof and for electron gun construction and processing, a desirable design maximum is about 4000 volts per resistive block where 40 mil (1.02 mm) thick blocks are used. However, higher stresses, e.g., up to 6000 volts per block, can be tolerated. If stresses much greater than 4000 volts/block are applied to the resistive blocks, electrical instability and arcing may occur.

2. An excessive number of stages in the lens stacks should be avoided since this adds to the total length of the gun and results in a more costly gun. Furthermore, theoretical analysis shows that additional stages beyond about seven produce very little reduction in aberration of the lens.

3. The proportional lengths of the paralleled entrance section of the lens and the unparalleled exit section of the lens should be selected so that:

a. The electrical stress on the stages of the exit section of the main focus lens is kept within the desired limits as described above.

b. In the case of the electron gun 10, an appropriate voltage is tapped from the main focus lens resistive stack for application to the G3.

c. The bend or elbow in the compound linear potential profile of the main focus lens is located such that the compound linear profile yields the desired exponential-like profile on the axis.

We have found that the potential profile of the lens is optimum when the elbow between the two linear voltage gradient slopes falls at about the geometric means of the focus voltage on the G4 and the ultor anode voltage on the G5. Most of the lens aberration effects on the electron beam occur at the entrance into the lens from the G4. Accordingly, moving the elbow away from the geometric mean toward the focus voltage will result in a more rapid increase in aberrations than a corresponding move in the other direction toward the ultor anode voltage.

Figure 6:
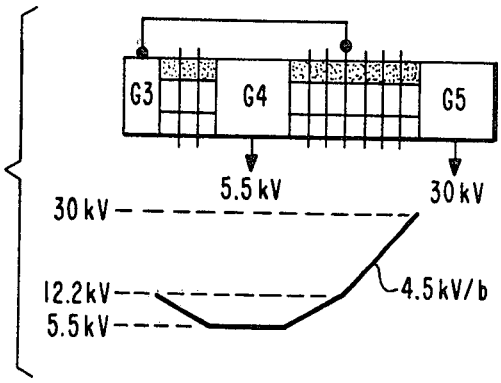
FIGS. 6, 7 and 8 are schematically illustrated variations of the electron gun of FIGS. 1 and 2.
Figure 7:
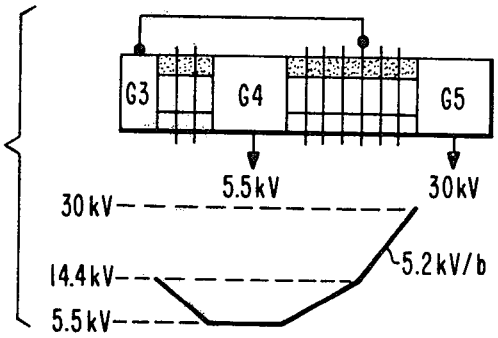
Figure 8:
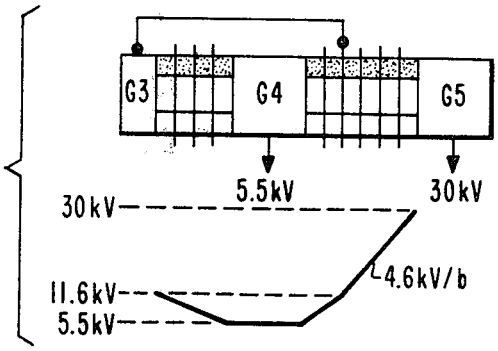

FIGS. 6, 7 and 8 schematically illustrate variations in design of the resistive lens of the electron gun 10 which result in slight variations of the potential profile of the focusing system. FIG. 6 schematically illustrates the electron gun 10 exactly as shown in FIGS. 1 and 2, wherein the G4–G5 main lens consists of seven stages and the G3–G4 secondary lens consists of three stages. The secondary lens is paralleled with the first three stages of the main lens thereby establishing the elbow of the compound linear potential profile only 0.6 kV below the geometric mean of the end lens voltages of the lens. The electron gun of FIG. 6 has been chosen to operate with 30 kV ultor potential on the G5 and 5.5 kV focus potential on the G4. Such a design results in a G3 voltage of 12.2 kV and a maximum stress on the exit section of the main lens of 4.5 kV per resistive block. The slope of the secondary lens between G3 and G4 is equal to, but of opposite polarity to, the slope of the entrance section of the main focus lens with which it is paralleled. Since these two paralleled sections are of equal number of resistive blocks, the slope of the entrance section of the main lens is one-half the slope of its exit section. Thus, the voltage gradients established along the six sections of the gun's focusing system are as follows:

| Lens Section | Voltage Gradient Slope |
|---|---|
| (1) first conductive electrode G3 | 0 |
| (2) first resistive lens 32 | −s |
| (3) second conductive electrode G4 | 0 |
| (4) second resistive lens (entrance section of 30) | +s |
| (5) third resistive lens (exit section of 30) | +2s |
| (6) third conductive electrode G5 | 0 |

where s is a positive slope value.

FIG. 7 schematically illustrates a variation of the design of FIG. 6 in which the same number of stages are used in each of the two lenses, but the tapped electrode of the main lens is one stage closer to the G5, thereby establishing the elbow of potential profile at about 1.6 kV above the geometric mean of the lens voltages. As a result, the two paralled sections are of unequal size and produce unequal potential profile slopes of their respective sections. Because of this unequal character of the two paralleled sections, the ratio of the potential profile slopes of the entrance to the exit sections of the main focus lens is about 1:2.3. In the lens design of FIG. 7, the tapped voltage fed to the G3 is 14.4 kV and the maximum stress on the main focus lens is 5.2 kV per block. Computer analysis shows this gun to have a minimum aberration spot size which is substantially identical to that of the gun of FIG. 6. In addition, the higher resulting G3 voltage of 14.4 kV is considered desirable, but the higher stress of 5.2 kV/block is less desirable.

FIG. 8 schematically illustrates a variation of the electron gun of FIG. 6 in which an additional stage is added to the G3–G4 secondary lens, one stage is removed from the G4–G5 main lens, and the tap for the G3 voltage is taken between the second and third stages of the main lens. This produces a potential profile having its elbow at about 1.2 kV below the geometric means of the lens voltages. The slope of the secondary lens is much less than that of the paralleled entrance section of the main lens, and the ratio of slopes of the entrance and exit sections of the main lens is about 1:1.5. The electrical stress of the lens is about 4.6 kV/block. Computer analysis shows this gun to have an aberration spot size which is significantly poorer than those of the FIG. 6 and FIG. 7 guns. This apparently results from the rather severe mismatch of the gun's 1:1.5 slope ratio with the optimum slope ratio. This gun also has an undesirably low G3 voltage of 11.6 kV, but an electrical stress value of 4.6 kV/block which is substantially equal to that of the FIG. 6 gun.

In designing the lenses 30 and 32 for the electron gun 10, the ultor voltage applied to the G5 is first chosen, for example, on the basis of the desired light output and other general circuit considerations. The voltage tapped back to the G3 is chosen on the basis of the particular design of the beam-forming region of the electron gun with which it is to cooperatively function. From these chosen voltages a focus voltage to provide proper focus for the beam projected into the focus lens region can be estimated. The lens design can thus be determined using the formula:

$$\frac{V_A - V_I}{S_2} = \frac{2(V_I - V_F)}{S_1}$$

where:

$V_A$=the ultor anode voltage, $V_I$=the intermediate voltage tapped back to the G3, $V_F$=the focus voltage applied to the G4, $S_1$=the number of stages in the secondary lens 32 and in the entrance stage of the main lens 30, and $S_2$=the number of stages in the exit section of the main lens 30.

For example, with the electron gun illustrated in FIG. 6, $V_A$=30 kV, $V_I$=about 12 kV, and $V_F$=about 5.5 kV.

From this, $S_2/S_1$ equals 18/13 or approximately 4/3 Thus the lens system is designed with four stages in the exit section of the main focus lens and three stages in each of the G3–G4 secondary lens and the entrance section of the G4–G5 main lens.

Figure 9:
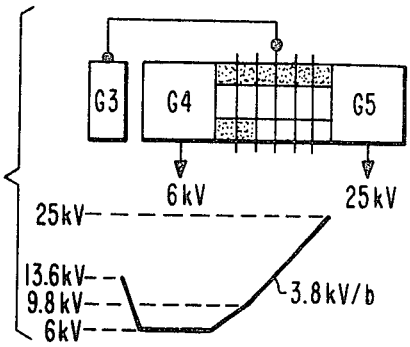
FIGS. 9, 10 and 11 are schematically illustrated variations of the novel electron gun of FIG. 5.
Figure 10:
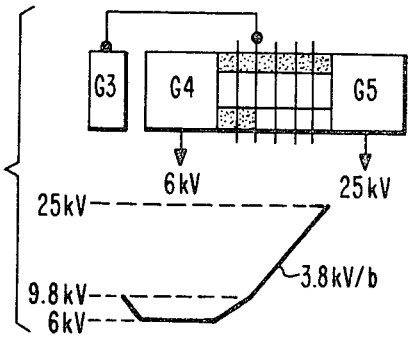
Figure 11:
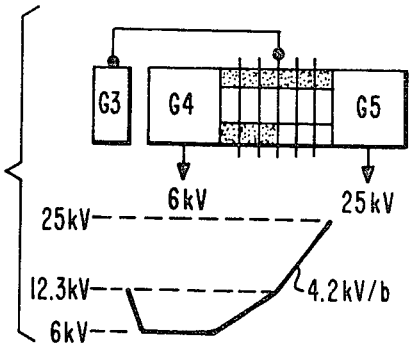

FIGS. 9, 10 and 11 schematically illustrate variations in design of the lens 130 of the electron gun 110. FIG. 9 illustrates a lens design exactly as described with reference to the electron gun 110 of FIG. 5. In this design the lens is provided with a total of six stages. The first two stages which constitute the entrance section of the lens are paralleled with a separate resistive 2-stage stack which is part of the same lens structure and uses electrode plates 134 which are common with electrode plates of the entrance section of the lens. With 25 kV chosen as an ultor voltage and 6 kV estimated for a focus voltage, the elbow of the compound linear voltage profile of the resistive stack occurs at 9.8 kV, which is 2.4 kV below the geometric mean voltage, and a maximum stress of 3.8 kV per resistive block results. A tapped voltage for the G3 is arbitrarily chosen between the third and fourth stages of the lens, which provides a voltage of 13.6 kV.

The design schematically illustrated in FIG. 10 differs from that of FIG. 9 only in that the tapped G3 voltage is taken between stages 2 and 3 of the main focus lens, resulting in a G3 voltage of 9.8 kV.

In FIG. 11, the electron gun design differs from that of FIG. 9 only in that the first three stages, instead of the first two stages, of the main focus lens are paralleled with a second resistive stack. As a result, the elbow of the compound linear potential profile of the main lens occurs at only about 0.1 kV above the geometric mean voltage, and a maximum electrical stress of 4.2 kV per block results. The tap for the G3 voltage is chosen to be between stages 3 and 4, thus providing a G3 voltage of 12.3 kV.

In the design of the lens 130 of the electron gun 110, the variable parameters are somewhat different from those of the electron gun 10. In the lens 130 a slope ratio between the entrance and exit sections of the main lens will always be equal to 1:2 since the two paralleled resistive lens stacks always contain the same number of resistive blocks. The slope variations, as disclosed in FIGS. 6–8 for the electron gun 10, are not possible with electron gun 110. On the other hand, selection of the tapped off voltage to be fed back to the G3 is completely independent of the paralleling arrangement and of the potential profile of the lens 130.

In designing the lens 130, the ultor voltage and the intermediate tapped voltage are chosen and the focus voltage estimated as with the electron gun 10. Then the number of total stages for the lens and the number of stages in the paralleled entrance section are arbitrarily chosen with regard to the basic design considerations discussed above for stress and for matching of the compound linear profile with an ideal exponential-like profile. From this, the potential profile is determined and the electrical stress per resistive block calculated using the following formula:

$$\text{Stress} = \frac{V_A - V_F}{S_T - S_{E/2}}$$

where:

$V_A$=ultor anode voltage applied to the G5, $V_F$=focus voltage applied to the G4,
$S_T$=total stages of the main lens, and
$S_E$=entrance section stages of the main lens.

For example, using the electron gun design of FIG. 9,
$V_A$=25 kV,
$V_F$=6 kV,
$S_T$=6, and
$S_E$=2.

From these values the stress is calculated to equal 3.8 kV/block.

Since the tapping-off of the G3 voltage from the resistive lens 130 is completely independent from the establishing of the 1:2 ratio potential profile, the lens 130 can be incorporated in an electron gun (not shown), wherein the G3 is omitted. For example, in its simplest embodiment, the lens 130 may be employed in a gun having a conventional bipotential focus lens. Generally speaking, the lens 130 may be employed in various electron gun modifications wherein electrostatic focusing is provided by creating a simple potential difference between two electrodes at one or more points of the gun. Notwithstanding, because of the superior beam spot character of tripotential guns, as described with reference to FIG. 5, it is preferred that the novel compound linear potential profile produced by the novel resistive lens structure 130 be embodied in such electron guns.

What is claimed is:

1. An electron gun comprising a plurality of lens electrodes spaced along a beam path, and a resistive lens structure physically disposed between said lens electrodes and having one end thereof electrically connected to one of said lens electrodes and the other end thereof electrically connected to the other of said lens electrode, said resistive lens structure comprising a plurality of apertured electrode plates alternately stacked with a plurality of equal resistance resistive spacer blocks so that said stack is electrically continuous from one end to the other, said stack comprising a first section having a given number of resistive blocks between each adjacent pair of electrode plates, and a second section having fewer than said given number of resistive blocks between each adjacent pair of electrode plates, and lead-in terminal means to said lens electrodes whereby potentials applied to said terminal means produces bleeder currents through said resistive lens structure so that the axial potential gradient established in said first section of said resistive lens structure is less than the axial potential gradient established in said second section, whereby to provide a compound linear potential profile along said resistive lens.

2. The electron gun of claim 1 wherein each stage of said first section includes two resistive blocks and each stage of said second section includes only one resistive block.

3. The electron gun of claim 1 wherein said first section is a beam entrance section of said lens structure and said second section is a beam exit section of said lens structure.

4. The electron gun of claim 1 wherein:

(a) said plurality of lens electrodes comprise first, second and third lens electrodes, (b) said resistive lens structure is physically disposed between and electrically connected to said second and third lens electrodes, (c) said gun further comprises an electrical connector connected between said first lens electrode and a point along said resistive lens structure.

5. The electron gun of claim 1 wherein:

(a) said plurality of lens electrode comprises first, second and third lens electrodes, (b) said resistive lens structure is physically disposed between and electrically connected to said second and third lens electrodes, (c) said resistive lens structure comprises a first section which is a beam entrance section and which has two stages each of which has two resistive blocks included therein and a second section which is a beam exit section and which comprises four stages each of which has one resistive block therein, and (d) said gun further comprises an electrical connector connected between said first lens electrode and a point at the boundary between the first and second stages of said second exit section of said lens structure.

* * * * *